US008776805B2

(12) United States Patent
deGrood

(10) Patent No.: US 8,776,805 B2
(45) Date of Patent: Jul. 15, 2014

(54) HAIR STYLING APPARATUS HAVING SELECTIVELY ADJUSTABLE CURLING COMPONENT

(75) Inventor: Michael John deGrood, Madison, WI (US)

(73) Assignee: Spectrum Brands, Inc., Middleton, WI (US)

( * ) Notice: Subject to any disclaimer, the term of this patent is extended or adjusted under 35 U.S.C. 154(b) by 275 days.

(21) Appl. No.: 13/029,230

(22) Filed: Feb. 17, 2011

(65) Prior Publication Data

US 2012/0211018 A1 Aug. 23, 2012

(51) Int. Cl.

| | |
|---|---|
| ***A45D 1/00*** | (2006.01) |
| ***A45D 2/40*** | (2006.01) |
| ***A45D 1/04*** | (2006.01) |

(52) U.S. Cl.

USPC ..... 132/224; 219/225

(58) Field of Classification Search

USPC ..... 132/224, 225, 226, 229, 231, 232, 234, 132/236, 266; 219/225, 229, 222

See application file for complete search history.

(56) References Cited

U.S. PATENT DOCUMENTS

| | | | | | |
|---|---|---|---|---|---|
| 1,473,312 | A | * | 11/1923 | Passard | 132/117 |
| 3,921,648 | A | | 11/1975 | Barradas | |
| 5,868,146 | A | * | 2/1999 | Henninger et al. | 132/232 |
| D489,482 | S | * | 5/2004 | Cho | D28/35 |
| 8,220,100 | B2 | * | 7/2012 | Diamond | 15/106 |
| 2008/0135537 | A1 | | 6/2008 | Suber et al. | |
| 2011/0203606 | A1 | | 8/2011 | Recchion et al. | |

FOREIGN PATENT DOCUMENTS

DE 202009005270 U1 2/2011

OTHER PUBLICATIONS

Extended European Search Report for Application No. 12154843.2 dated May 14, 2012, 7 pages.

* cited by examiner

*Primary Examiner* — Robyn Doan
(74) *Attorney, Agent, or Firm* — Armstrong Teasdale LLP

(57) ABSTRACT

A hair styling apparatus includes a curling component generally proximate to the hair-heating surface and operatively connected to at least one of first and second arms of the apparatus. The curling component has a curling edge selectively movable laterally with respect to a hair-heating surface of the apparatus to configure the curling component between a retracted configuration, in which the curling edge is spaced a retracted lateral distance from a lateral edge of the hair-heating surface, and an extended configuration, in which the curling edge is spaced an extended lateral distance, greater than the retracted lateral distance, from the lateral edge of the hair-heating surface.

25 Claims, 10 Drawing Sheets

HAIR STYLING APPARATUS HAVING SELECTIVELY ADJUSTABLE CURLING COMPONENT

FIELD OF THE DISCLOSURE

The present disclosure relates generally to hair styling apparatus, and more particularly to a hair styling apparatus having a selectively adjustable curling component for use in curling hair.

BACKGROUND OF THE DISCLOSURE

Many different types of hair styling apparatus are available for use in styling hair, such as straightening, curling, waving or otherwise achieving a desired look. Common among such hair styling apparatus is the ability to apply heat to the hair, and in particular to provide one or more heated surfaces against which the hair to be styled is contacted during styling. For example, flat irons (which are also sometimes referred to as heated tongs or hair straighteners) often have a pair of arms that are moveable relative to one another between a closed position, in which at least portions of the arms are in close proximity to one another to hold hair therebetween, and an open position, in which the arms are spaced from one other such that the arms are generally inoperative to hold hair. A heating member with a heating surface is provided on at least one of the arms, and more typically on both of the arms. In use, the hair being styled is sandwiched between the heating surfaces of the heating members when the arms are in their closed position.

The hair may be straightened as a result of the heat and pressure applied by the heating members, or the hair may be curled. In particular, when using the flat iron to curl hair, the flat iron may be manually rotated about its axis. Portions of the hair between the heating plates are heated, and as the flat iron is rotated and moved along the hair, the heated hair wraps over a relatively cooler cooling edge of the flat iron. The hair takes on a curled shape upon cooling of the hair on the cooling edge.

SUMMARY

In one aspect, a hair styling apparatus generally comprises first and second arms each having opposite ends and an imaginary axis extending between the opposite ends. The first and second arms are pivotably secured to one another for selective, pivotal movement toward one another to configure the hair styling apparatus in a closed position. A heating member on the first arm has a hair-heating surface in generally opposing relationship with the second arm for applying heat to hair between the first and second arms in the closed position of the hair styling apparatus. The hair-heating surface has a lateral edge. A curling component generally proximate to the hair-heating surface and operatively connected to at least one of the first and second arms has a curling edge selectively movable laterally with respect to the hair-heating surface to configure the curling component between a retracted configuration, in which the curling edge is spaced a retracted lateral distance from the lateral edge of the hair-heating surface, and an extended configuration, in which the curling edge is spaced an extended lateral distance, greater than the retracted lateral distance, from the lateral edge of the hair-heating surface.

In another aspect, a hair styling apparatus generally comprises first and second arms each having opposite ends and an axis extending between the opposite ends. The first and second arms are pivotably secured to one another for selective, pivotal movement toward one another to configure the hair styling apparatus in a closed position. First and second heating members on the respective first and second arms for applying heat to hair between the first and second arms in the closed position of the hair styling apparatus have respective hair-heating surfaces in generally opposing relationship with one another. Each hair-heating surface has a lateral edge. A first curling component is operatively connected to the first arm and has a curling edge. The curling edge of the first curling component is selectively movable laterally with respect to the hair-heating surface of the first heating member to configure the first curling component between a retracted configuration, in which the curling edge of the first curling component is spaced a retracted lateral distance from the lateral edge of the hair-heating surface of the first heating member, and an extended configuration, in which the curling edge of the first curling component is spaced an extended lateral distance, greater than the retracted lateral distance, from the lateral edge of the hair-heating surface of the first heating member. A second curling component is operatively connected to the second arm and has a curling edge. The curling edge of the second curling component is selectively movable laterally with respect to the hair-heating surface of the second heating member to configure the second curling component between a retracted configuration, in which the curling edge of the second curling component is spaced a retracted lateral distance from the lateral edge of the hair-heating surface of the second heating member, and an extended configuration, in which the curling edge of the second curling component is spaced an extended lateral distance, greater than the retracted lateral distance, from the lateral edge of the hair-heating surface of the second heating member.

In yet another aspect, a method of styling hair using a hair styling apparatus of the type including first and second arms that are pivotably secured to one another for selective, pivotal movement toward one another to close the hair styling apparatus, and first and second heating members on the respective first and second arms having respective hair-heating surfaces with respective lateral edges, generally comprises adjusting a lateral distance between a curling edge of a curling component of the hair styling apparatus and at the lateral edge of the first heating member to configure the curling component in a selected one of a plurality of different configurations. Hair is disposed between the hair-heating surfaces of the first and second heating members, and the hair is curled using the curling edge of the curling component.

BRIEF DESCRIPTION OF THE DRAWINGS

Corresponding reference characters indicate corresponding parts throughout the drawings.

DETAILED DESCRIPTION OF THE DRAWINGS

Figure 1:
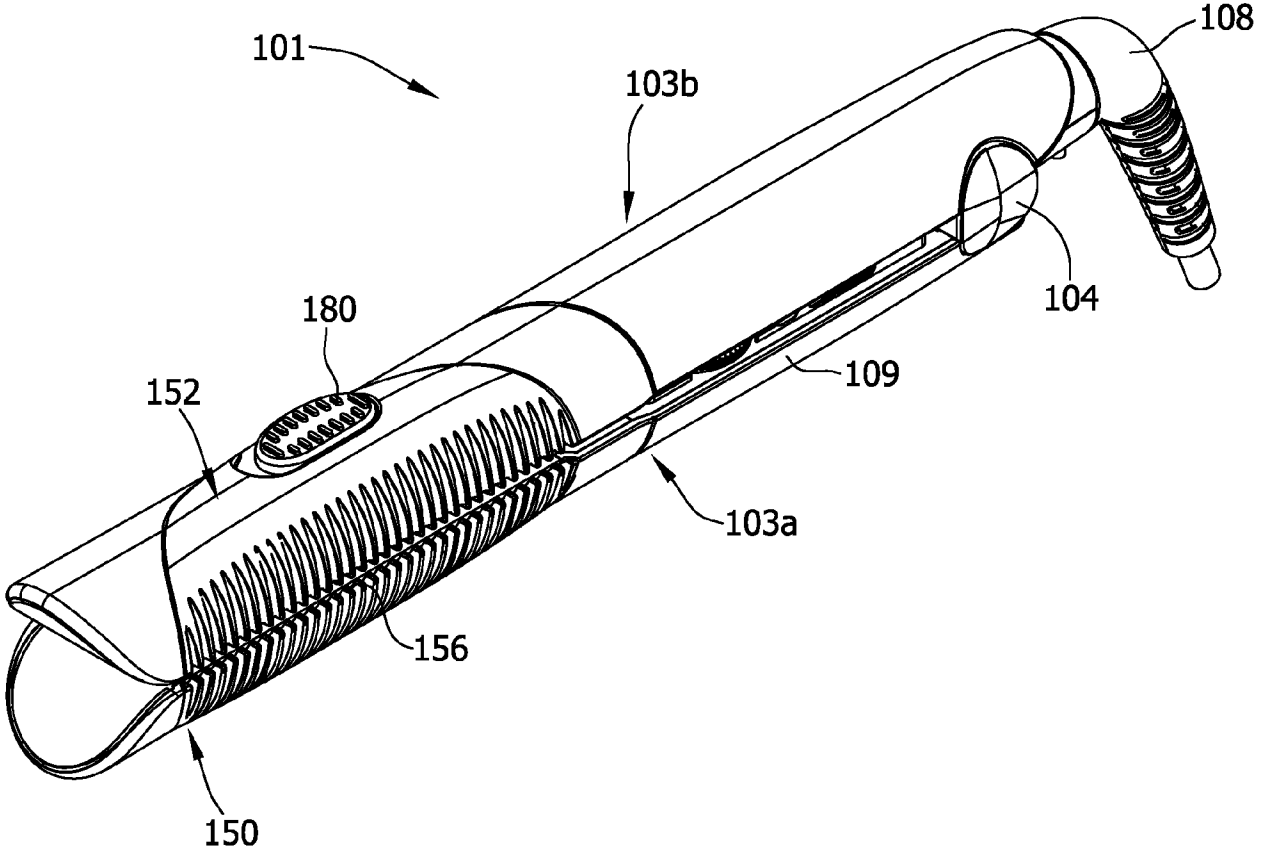
FIG. 1 is a perspective of a hair styling apparatus having selectively adjustable curling components, the hair styling apparatus being in a closed position.
Figure 2:
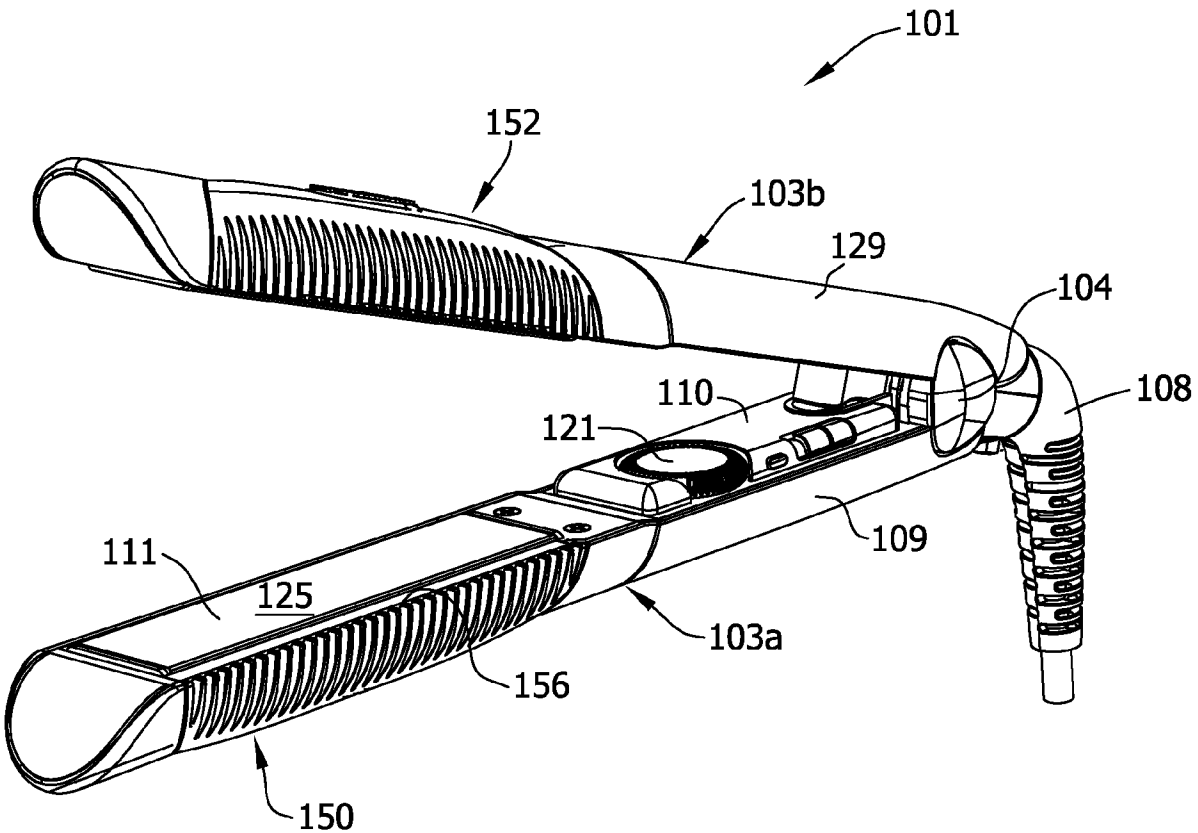
FIG. 2 is a perspective of the hair styling apparatus of FIG. 2 with the hair styling apparatus in an open position.

Referring now to the drawings and in particular to FIGS. 1 and 2, one embodiment of a hair styling apparatus according to the present invention is generally designated 101. The illustrated hair styling apparatus 101 is generally in the form of a flat iron (also referred to as a hair straightener), which can be used to straighten and curl hair. As explained in more detail below, the hair styling apparatus 101 comprises two hair curling components, generally indicated at 150, 152, for use in curling hair using the apparatus. The hair curling components 150, 152 are selectively adjustable to allow a user to selectively adjust curl size and/or curl tightness of the hair to a desired curl size and/or a desired curl tightness. It is contemplated that the hair styling apparatus 101 may be of a different type, other than a flat iron, such as a curling iron or other suitable type of hair styling apparatus that is adapted to heat hair and facilitate curling of the hair. It is also contemplated that in other embodiments the hair styling apparatus 101 may include one, or more than two, hair curling components.

The flat iron 101 is generally elongate with opposite longitudinal ends and has first and second arms (lower and upper arms as illustrated in FIGS. 1 and 2), generally indicated at 103*a* and 103*b*, respectively, held in assembly with each other by a suitable pivot connection 104 at one of the longitudinal ends of the flat iron. The first and second arms 103*a*, 103*b* are thus moveable relative to one another and about a pivot axis of the pivot connection 104 between an open position (FIG. 1) of the flat iron 101 and a closed position (FIG. 2) thereof. A biasing member in the form of a compression spring 105 (FIG. 3) is suitably positioned between the first and second arms 103*a*, 103*b* adjacent to the pivot connection 104. In particular, the spring 105 is seated within opposed spring seats 106 (one of which is illustrated in FIGS. 3 and 4) formed on each arm to urge the arms toward the open position of the flat iron 101.

Figure 3:
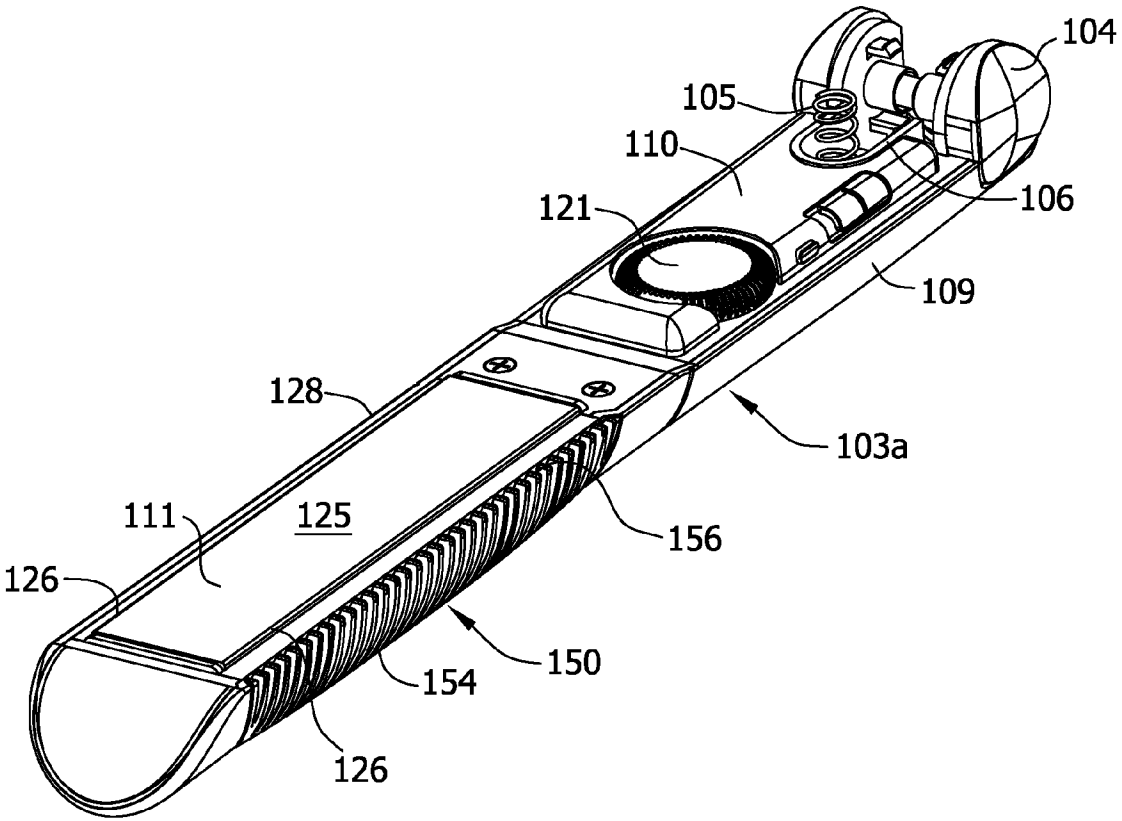
FIG. 3 is a perspective of a first arm of the hair styling apparatus, a second arm being removed therefrom.
Figure 4:
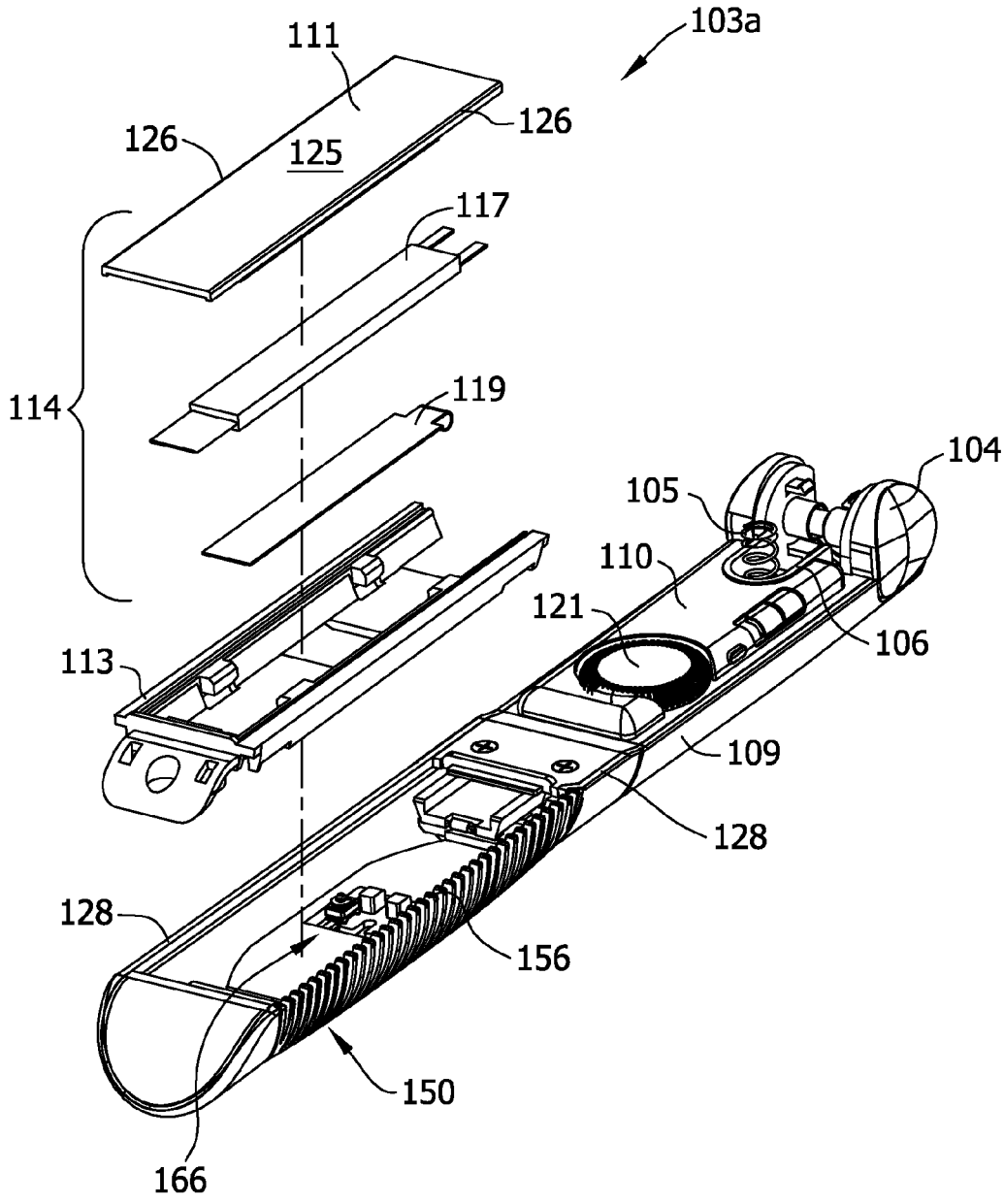
FIG. 4 is a perspective of the first arm of FIG. 3 with a heating member assembly exploded therefrom.
Figure 5:
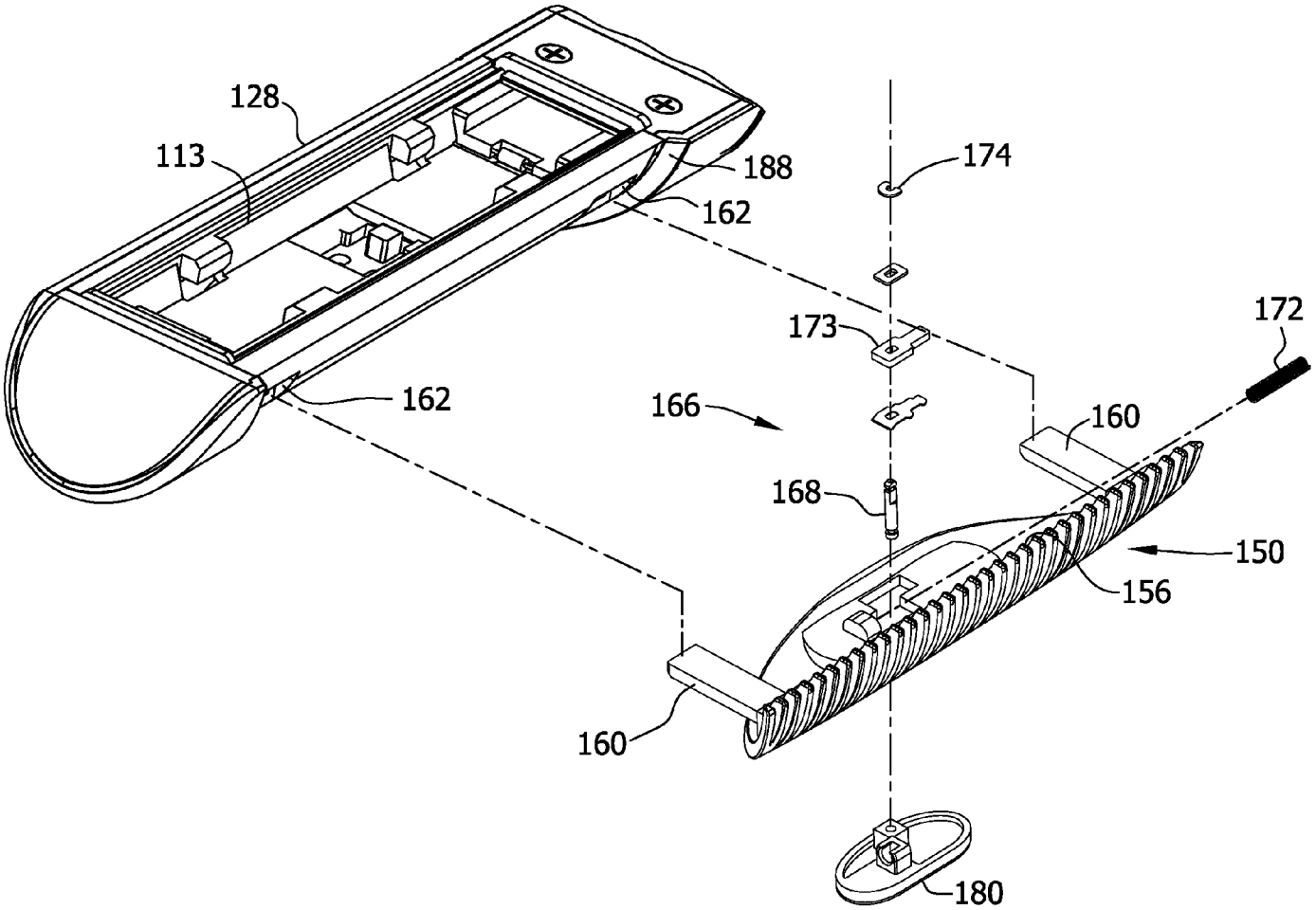
FIG. 5 is a partial perspective of the first arm of FIG. 3 with a curling component exploded therefrom.

With particular reference to the first arm 103*a* of the flat iron 101 as illustrated in FIGS. 2-4, the first arm comprises an outer shell or housing member 109 having an interior space in which various components of the flat iron are located. For example, longitudinally adjacent to the spring seat 106 is an access panel 110 on the exterior surface that together with the housing member 109 of the first arm 103*a* encloses a suitable control system (not shown) for controlling operation of the flat iron (such as power on/off and/or heat output control). The control system is electrically connected to a suitable power source (not shown) via an electrical cord 108 (FIGS. 1 and 2) that is connected to the flat iron 101 rearward of the pivot connection 104, and by suitable internal wiring (not shown) between the cord and the control system. A suitable switch 121, and in particular a rotatable dial in the illustrated embodiment, is accessible exterior of the first arm 103*a* and is useable by the user to operate the control system of the flat iron 101.

While in the illustrated embodiment the switch 121 and control system are located on the first arm 103*a* of the flat iron 101, it is understood that the switch and control system may instead be located on the second arm 103*b* of the flat iron. It is also contemplated that separate switches may be provided, one for power on/off and another for controlling the heat output, or that a single power on/off switch may be provided without the ability to control the heat output, and remain within the scope of this invention. Other configurations are also possible and do not depart from the scope of the present invention.

Referring to FIG. 4, a cradle insert 113 seats within the interior space of the housing member 109 and forms a cradle in which a heating member assembly 114, is seated and secured. The heating member assembly 114 comprises a heating member 111, which is in the form of a generally rectangular plate in the illustrated embodiment, a heating unit 117 disposed within the housing member and electrically connected to the control system via suitable wiring (not shown), and a temperature sensing unit 119, which may include a thermistor electrically connected to the control system, and heat conductor in thermal contact with the heating unit.

The heating unit 117 suitably comprises one or more heaters, such as electrical resistance heaters (e.g., PTC heating units), positioned in contact with or in sufficiently close proximity to the heating member 111 to heat the heating member during use of the flat iron 101. For example, in one suitable embodiment the heating unit 117 is operable to heat the heating member 111 to a styling temperature of at least about 100 degrees Celsius, and may heat the heating member up to a temperature of about 250 degrees Celsius. In another embodiment the heating unit 117 is operable to heat the heating member 111 to a styling temperature in the range of about 180 to about 230 degrees Celsius. It is understood that other suitable heating units or heating methods may be used to heat the heating member 111 without departing from the scope of this invention.

The heating member 111 of the illustrated embodiment is generally rectangular and sized to seat at least partially within the cradle insert 113. The heating member 111 has an exposed hair-heating surface 125 opposing the second arm 103*b* of the flat iron 101. The hair-heating surface 125 has opposite lateral edges 126. In the illustrated embodiment, the lateral edges 126 are spaced laterally inward from respective adjacent lateral edges 128 of the housing 109 of the first arm 103*a*. Also in the illustrated embodiment, the hair-heating surface 125 and lateral edges 126 are disposed above the lateral edges 128 of the housing. It is understood that another component, such as a thermal insulator, may be disposed on the hair-heating surface 125. The heating member 111 may be constructed of any suitable material, such as, without limitation, metal, ceramic materials or combinations thereof as is known in the art. The heating member 111 may be of other configurations, including other shapes and sizes, without departing from the scope of the present invention.

With particular reference to the second or upper arm 103*b* of the flat iron 101 as illustrated in FIGS. 1 and 2, the second arm is constructed substantially similar to the first arm 103*a*. Generally, the second arm 103*b* comprises an outer shell or housing member 129 that generally defines an interior space in which various components of the flat iron are located. A second heating member assembly (not shown) is carried by the second arm 103*b* of the flat iron 101 and is constructed substantially similar to the heating member assembly 114 carried by the first arm 103*a*. In general, the heating member of the second heating member assembly has a hair-heating surface generally opposing the first arm 103*a*, and more particularly, the hair-heating surface 125 of the first hair heating member 111. The hair-heating surface has opposite lateral edges, similar to the first hair-heating surface 125.

The heating members 111 of the respective heating member assemblies 114 of the first and second arms 103*a*, 103*b* are sufficiently located longitudinally on the respective arms so that in the closed position of the flat iron 101, the hair-heating surfaces 125 sandwich and compress hair therebetween. In the open position of the flat iron 101, the hair-facing surfaces 125 of the heating members 111 are spaced apart from one another a sufficient distance to allow the introduction of hair between the hair-facing surfaces.

Referring to FIGS. 1 and 2, the first and second curling components 150, 152, respectively, are generally proximate to the respective hair-heating surfaces 125 of the first and second heating members 111, and are operatively secured to the respective first and second arms 103*a*, 103*b* to allow selective displacement of the curling components 150, 152 relative to the respective arms, as explained in more detail below. Other than being operatively connected to different arms 103*a*, 103*b*, the illustrated first and second curling components 150, 152 are substantially identical, and therefore, for ease of explanation, only the first curling component will be described in detail herein, with the understanding that the features of the first curling component apply equally to the second curling component. It is also understood that the flat iron 101 may comprise only one or more than two adjustable curling components without departing from the scope of the present invention. It is further understood that other embodiments may include two or more curling components that are not substantially identical to each other.

As seen best in FIG. 3, the illustrated first curling component 150 comprises a body 154 defining a curling edge 156 that is disposed laterally outward from an adjacent one of the lateral edges 126 of the heating surface 125 of the first heating member 111. The illustrated curling edge 156 extends along a substantially linear axis, generally parallel to the axis of the first arm 103*a*, and lies in a lateral plane that is generally parallel to and offset from (e.g., below) the heating surface 125 of the heating member 111. It is contemplated that the curling edge 156 may extend along a non-linear path (e.g., a curved path), and/or the curling edge may be other than parallel to the axis of the first arm 103*a* without departing from the scope of the present invention. At least the curling edge 156, and in the illustrated embodiment the entire body 154, remains at a temperature less than the temperature of the heating member 111. For example, the body 154 or at least the curling edge 156 may be formed from material that is substantially thermally non-conductive or may be substantially thermally insulated from the heating member 111 and the heating unit 117 such that the curling edge remains at a temperature less than the temperature of the heating member in use. The curling component 150 may be formed from a suitable plastic or from other suitable material.

As explained in more detail below, the curling component 150 is operatively connected to the first arm 103*a* such that the body 154 and thus the curling edge 156 are selectively movable laterally with respect to the adjacent lateral edge 126 of the first heating member 111. The body 154 is selectively movable along a substantially linear path that is substantially orthogonal to both the axis of the first arm 103*a* and the axis of the curling edge 156. In another embodiment, the body 154 may be movable laterally outward from the first arm 103*a* along a non-linear path (e.g., a curved path) such that the curling edge 156 translates along a non-linear path. For example, the curling component 150 may be hingedly secured to the first arm 103*a* such that the curling edge 156 moves along (i.e., rotates about) an arcuate path. In this example, the curling edge 156 is selectively movable laterally with respect to the adjacent lateral edge 126 of the first heating member 111. In another example, the curling edge 156 may be movable along an arcuate path extending alongside the first arm 103*a* and still be movable laterally with respect to the adjacent lateral edge 126 of the first heating member 111. Other ways of making the curling component 150, and in particular the curling edge 156, selectively movable laterally with respect to the adjacent lateral edge 126 of the first heating member 111 are within the scope of the present invention.

Figure 6:
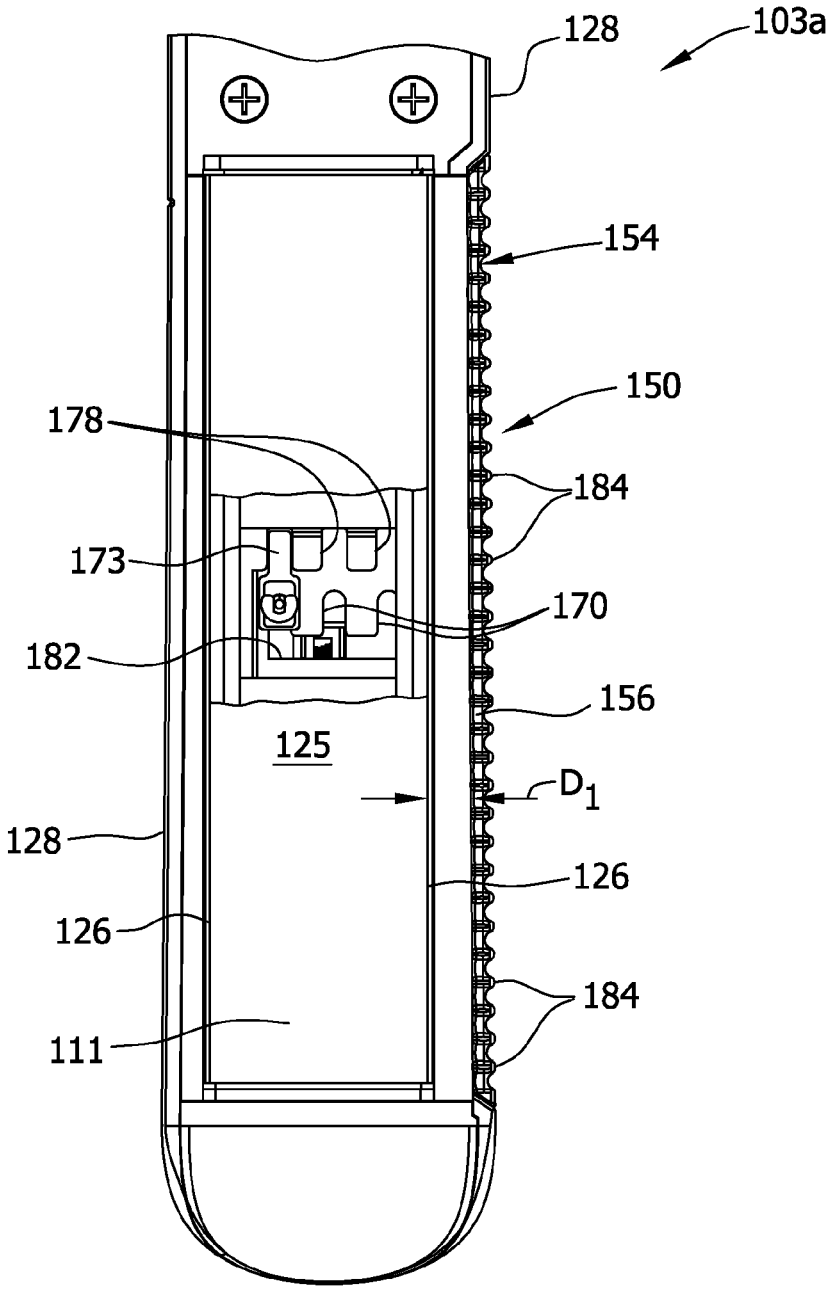
FIG. 6 is a partial top plan view of the first arm of FIG. 3 with a portion removed to show a locking mechanism of the curling component, the curling component being in a retracted configuration.
Figure 7:
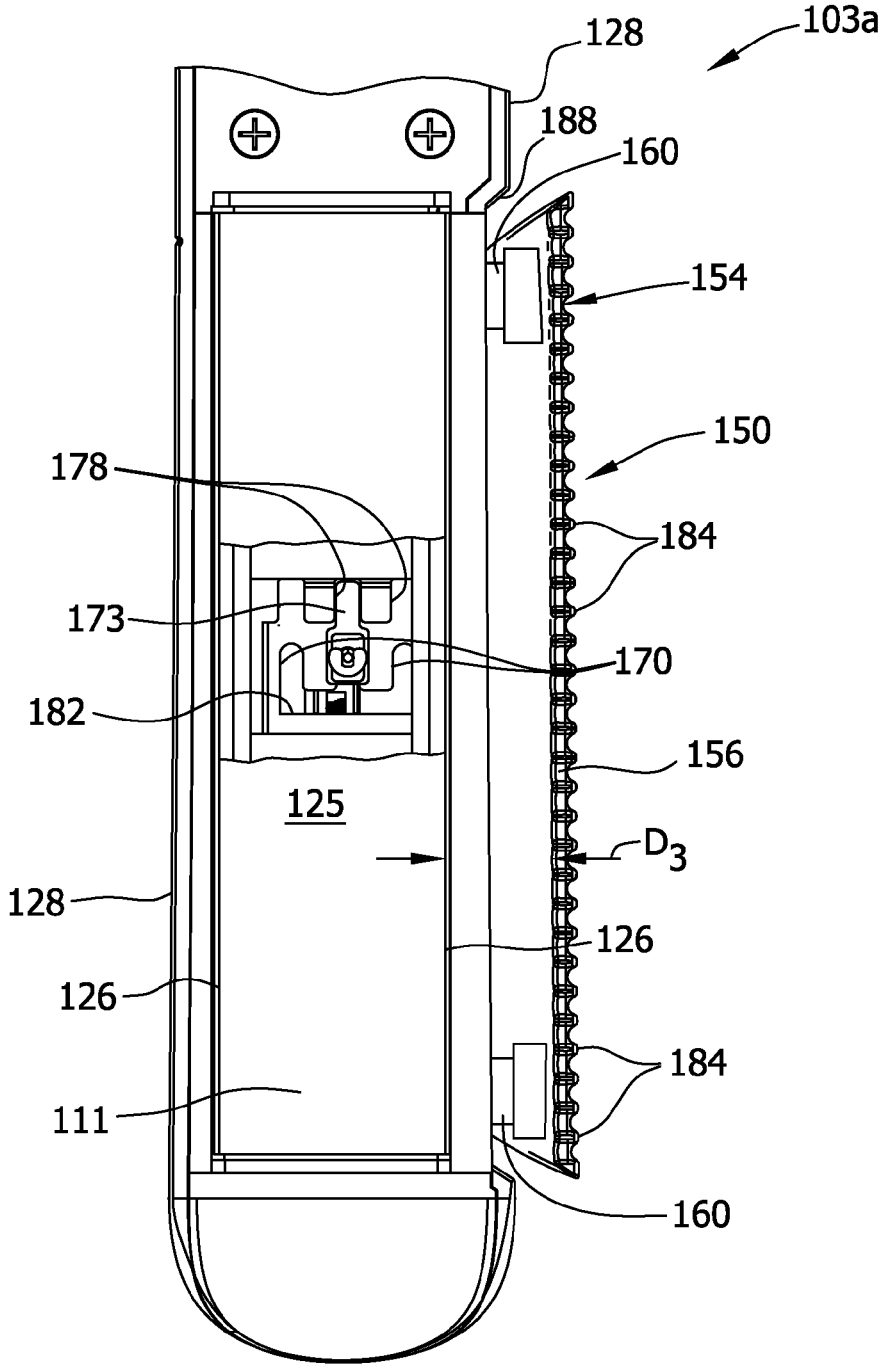
FIG. 7 is similar to FIG. 6 except the curling component is in an intermediate configuration.
Figure 8:
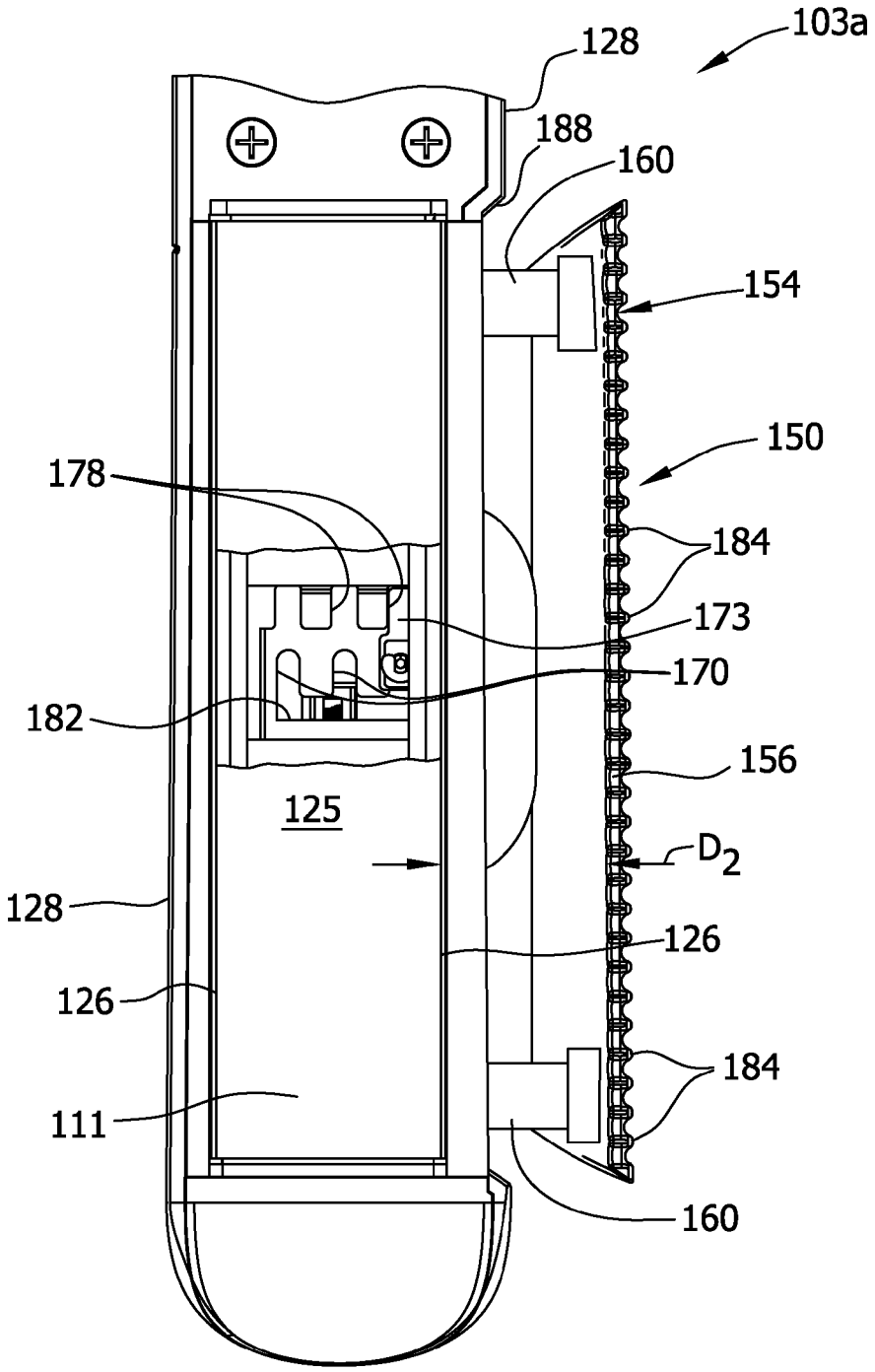
FIG. 8 is similar to FIG. 6 except the curling component is in an extended configuration.
Figure 9:
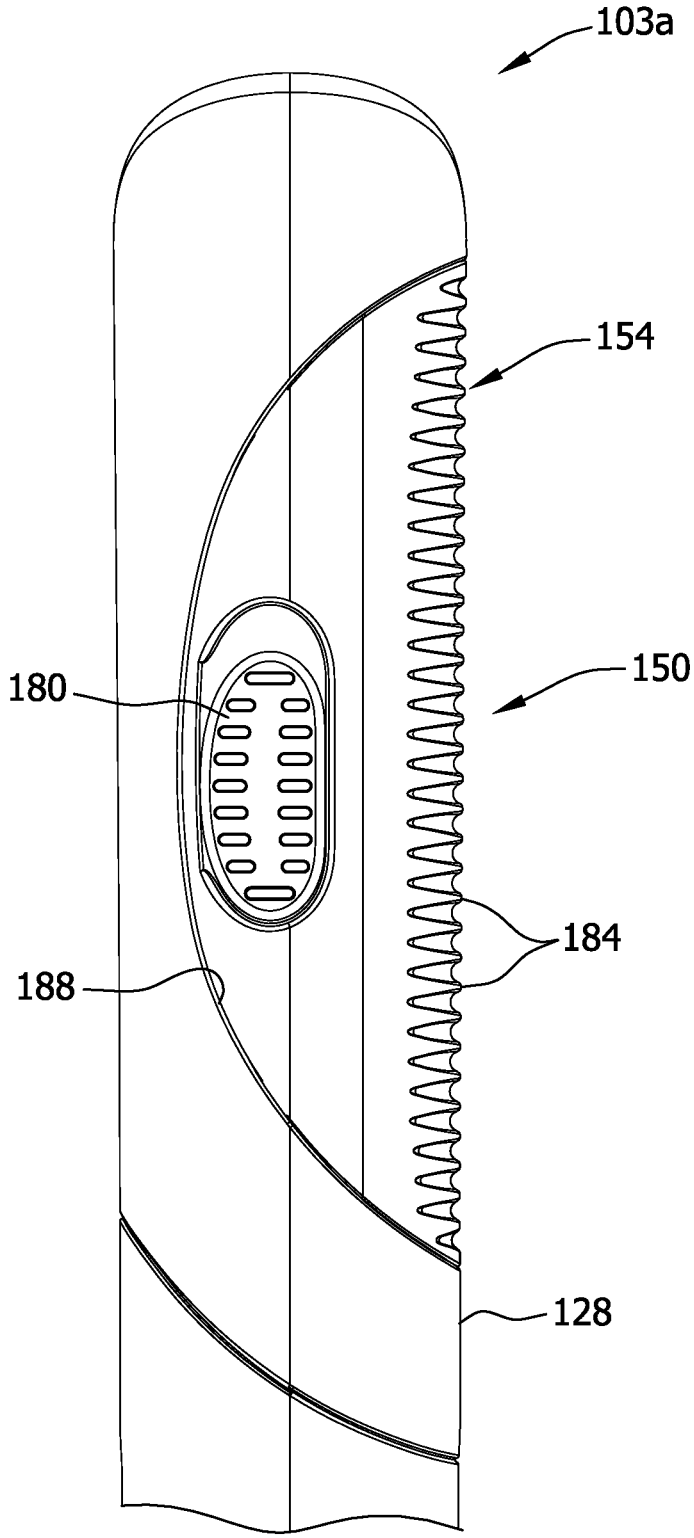
FIG. 9 is a bottom plan view of the first arm of FIG. 6.
Figure 10:
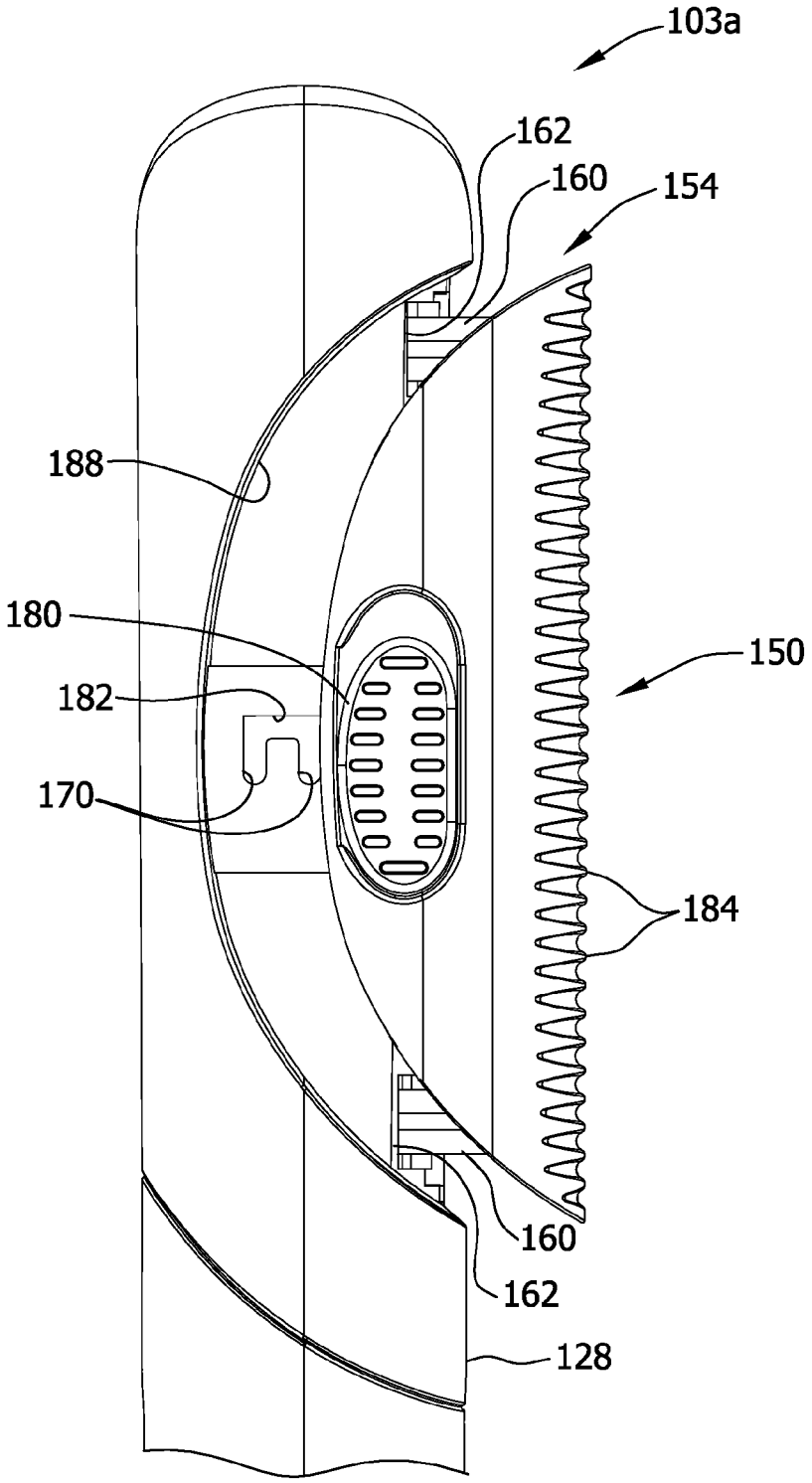
FIG. 10 is a bottom plan view of the first arm of FIG. 8.

In particular, in the illustrated embodiment the curling edge 156 is movable relative to the first arm 103*a* to configure the curling component 150 between a retracted configuration (FIGS. 1-4, 6 and 9), in which the curling edge is spaced a retracted distance D1 (FIG. 6) from the lateral edge 126 of the heating surface 125; and an extended configuration (FIGS. 8 and 10), in which the curling edge is spaced an extended lateral distance D2 (FIG. 8), greater than the retracted lateral distance D1, from the lateral edge of the heating surface; and at least one intermediate configuration (FIG. 7), in which the curling edge is spaced an intermediate lateral distance D3, intermediate the retracted and extended lateral distances, from the lateral edge of the heating surface. In one non-limiting example, the retracted lateral distance D1 may measure from about 0 mm to about 6 mm, and in one example, about 4 mm; the extended lateral distance D2 may measure from about 10 mm to about 20 mm, and in one example, about 16 mm; and one of the intermediate lateral distances D3 may measure from about 5 mm to about 15 mm, and in one example, about 10 mm. Although in the illustrated embodiment the curling component 150 is selectively configurable to a single intermediate configuration, in other embodiments the curling component may be selectively configurable to more than one intermediate configuration. Moreover, in yet another embodiment the curling component 150 may be selectively configurable only between retracted and extended configurations.

In the illustrated embodiment, the curling component 150 further comprises a pair of telescoping arms 160 extending outward from an inner surface of the body 154 and slidably connected to the first arm 103*a*. More specifically, the telescoping arms 160 are slidably received in channels 162 in the first arm 103*a*. The telescoping arms 160 support the body 154 of the curling component 150 as the body is moved relative to the first arm, and facilitate moving the body along a linear, lateral path. Other ways of supporting the body 154 on the first arm 103*a* and facilitating movement of the body and/or the curling edge 156 relative to the lateral edge 126 of the heating member 111 do not depart from the scope of the present invention.

A locking mechanism 166 operatively connects the curling component 150 to the first arm 103*a* and facilitates selective locking and unlocking of the curling component in the respective retracted, extended, and intermediate configurations. The locking mechanism 166 includes a locking pin 168 on the curling component 150 that is selectively slidable relative to the first arm 103*a* between a plurality (e.g., three) of spaced apart locking slots 170 defined by the first arm. Each of the locking slots 170 corresponds to one of the respective retracted, extended and intermediate configurations of the curling component. In particular, the locking pin 168 is selectively slidable into and out of engagement with the locking slots 170 to adjust the lateral displacement of the curling edge 156 relative to the lateral edge 126 of the hair-heating surface 125. The locking pin 168 is resiliently biased and urged toward the locking slots 170 by a spring member 172 (e.g., a compression spring) to inhibit the locking pin from inadvertently disengaging (i.e., withdrawing) from the corresponding locking slot in which it is received. Thus, in the illustrated embodiment the curling component 150 is movable to discrete intervals of displacement relative to the lateral edge 126 of the hair-heating surface 125. The locking mechanism 166 may be of other configurations without departing from the scope of the present invention. For example, the locking mechanism may be configured to allow the curling component 150 to be movable to an infinite number of intermediate configurations.

In the illustrated embodiment, the locking mechanism 166 is secured to the first arm 103*a* by an attachment member 173 extending laterally outward from the locking pin 168. The attachment member 173 is secured to the locking pin 168 by a fastening ring 174, although the attachment member may be secured to the locking pin in other ways and may be formed integrally therewith. The attachment member 173 also functions as an anti-rotation device. Upon insertion of the locking pin 168 into a selected one of the locking slots 170, the attachment member 173 slides into a respective one of a plurality of anti-rotation slots 178 formed in the first arm 103*a*. Each of the anti-rotation slots 178 is aligned with a respective one of the locking slots 170. Through this configuration, the attachment member 173 inhibits rotation of the curling component 150 during use. It is understood that the locking mechanism may be secured to the first arm 103*a* in other ways without departing from the scope of the present invention.

An actuator, in the form of a slidable button 180 on the exterior surface of the first arm 103*a*, is operatively connected to the pin 168. The button 180 is manually operable, although it is contemplated the actuator may be automatically operable, such as by a motor. The button 180 is slidable relative to the first arm 103*a* in a direction opposite the biasing force of the spring member 172 to selectively move the pin 168 out of the corresponding slot and unlock the curling component 150. When the pin 168 is withdrawn from the slots 170, the body 154 of the curling component 150 can be moved laterally, as discussed above, whereby the pin moves within a slot-connecting track 182 that extends perpendicular to and connects the slots. Upon releasing the button 180 when the curling component 150 is in a selected one of the retracted, extended and intermediate configurations, the pin 168 and the anti-rotation member 173 are urged into the corresponding locking slot 170 and anti-rotation slot 178 under the force of the spring member 172, thereby temporarily locking the curling component in the selected configuration.

The illustrated curling component 150 includes a plurality of teeth 184 that are spaced apart from one another along the body 154 of the curling component and extend partially around the body. The teeth 184 extend from the curling edge 156 such that the curling edge is formed as a comb. Other ways of forming the curling edge as a comb do not depart from the scope of the present invention. The teeth 184 and the illustrated curling edge 156 inhibit hair from sliding and bunching up along the curling edge 156 and the exterior surface of the body 154 when curling hair using the curling component 150. The curling component 150 may not include the teeth 184 and/or the curling edge 156 may not be formed as a comb without departing from the scope of the present invention. For example, one or both of the curling edge 156 and the exterior surface of the body 154 may be substantially smooth or may have other surface contours.

In the illustrated embodiment, the body 154 of the curling component 150 is received in a recess 188 formed in the exterior surface of the first arm 103*a* when the curling component is configured in its retracted configuration. The body 154 of the curling component 150 is substantially commensurate in size and shape with the recess 160 such that an exterior surface of the body 154 visually appears to be integral with the exterior surface of the housing member 109 of the first arm 103*a* when the curling component is configured in its retracted configuration. Moreover, in the retracted configuration, the curling edge 156 is substantially aligned (i.e., coaxial) with the lateral edge 128 of the first arm 103*a*. In the illustrated embodiment, the exterior surface of the body 154 is generally arcuate and, when in the retracted configuration, extends transversely and partially around the housing member 109 from adjacent to one of the lateral edges 126 of the housing member 109 to a location intermediate the two lateral edges. In the extended and intermediate configurations, the body 154 of the curling component 150 is at least partially removed from the recess 160.

In an exemplary method, the flat iron 101 may be used to either straighten or curl hair. To curl hair using the illustrated flat iron 101, the user selects one of the retracted, expanded and intermediate configurations of the curling component 150 and makes any necessary adjustments of the curling component by sliding the button 180 to unlock the curling component and telescopingly slide the curling component laterally relative to the first arm 103*a*. It is believed that the respective configurations of the curling component 150 facilitate the formation of different types of curls having different sizes and/or different tightness due to the differences in the lateral distances D1, D2, D3 from the lateral edge 126 of the hair-heating surface 125 to the curling edge 156 in the respective retracted, extended and intermediate configurations of the curling component. In particular, to form relatively smaller and tighter curls, the user may configure the curling component 150 into the retracted configuration, and then use the curling component to curl the hair. To form relatively larger, less tight curls, the user may configure the curling component 150 into the extended configuration, and then use the curling component to curl the hair. Likewise, to form curls of relatively intermediate size and tightness, the user may configure the curling component 150 into the intermediate configuration (or one of the intermediate configurations where there are more than one intermediate configurations), and then use the curling component to curl the hair.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A hair styling apparatus comprising:

first and second arms each having opposite ends and an imaginary axis extending between the opposite ends, the first and second arms pivotably secured to one another for selective, pivotal movement toward one another to configure the hair styling apparatus in a closed position;

a heating member on the first arm, the heating member having a hair-heating surface in generally opposing relationship with the second arm for applying heat to hair between the first and second arms in the closed position of the hair styling apparatus; and a curling component connected to the first arm via a connector, wherein the curling component is selectively movable with respect to the axis of the first arm to configure the curling component between a retracted configuration, in which a curling surface of the curling component is spaced a retracted distance from the hair-heating surface, and an extended configuration, in which the curling surface of the curling component is spaced an extended distance, greater than the retracted distance, from the hair-heating surface, at least part of the connector being movable conjointly with the curling component so as to be closer to the axis of the first arm when the curling component is in the retracted configuration than when the curling component is in the extended configuration.

2. The hair styling apparatus set forth in claim 1 wherein the connector is a locking mechanism for selectively and releasably locking the curling component in the retracted and extended configurations.

3. The hair styling apparatus set forth in claim 2 wherein the locking mechanism comprises an actuator to facilitate at least selective unlocking of the curling component to allow the curling component to be selectively moved with respect to the axis.

4. The hair styling apparatus set forth in claim 2 wherein the curling component is selectively movable with respect to the axis to further configure the curling component in an intermediate configuration, in which the curling surface is spaced an intermediate distance, intermediate the retracted and extended distances, from the hair-heating surface.

5. The hair styling apparatus set forth in claim 4 wherein the curling component is selectively movable with respect to the axis to a plurality of discrete displacement intervals to selectively configure the curling component in said retracted, extended, and intermediate configurations.

6. The hair styling apparatus set forth in claim 4 wherein the locking mechanism is configured for selectively and releasably locking the curling component in the retracted, extended, and intermediate configurations.

7. The hair styling apparatus set forth in claim 4 wherein the intermediate configuration comprises a plurality of different intermediate configurations.

8. The hair styling apparatus set forth in claim 4 wherein the intermediate configuration comprises substantially an infinite number of intermediate configurations.

9. The hair styling apparatus set forth in claim 1 wherein the curling surface defines at least a portion of a curling edge.

10. The hair styling apparatus set forth in claim 1 wherein the first arm has an exterior surface and a recess defined in the exterior surface, wherein at least a portion of the curling component is received in the recess when the curling component is in the retracted configuration and is removed from the recess when the curling component is in the extended configuration.

11. The hair styling apparatus set forth in claim 10 wherein the curling surface of the curling component is commensurate in size and shape with the recess in the exterior surface of the first arm.

12. The hair styling apparatus set forth in claim 1 wherein the curling surface is generally arcuate.

13. The hair styling apparatus set forth in claim 1 wherein at least a portion of the curling surface is formed as a comb.

14. The hair styling apparatus set forth in claim 1 wherein the curling component is telescopingly connected to the first arm such that the curling component is linearly movable with respect to the axis.

15. The hair styling apparatus set forth in claim 1 wherein the connector is one of a locking mechanism, a support arm, and a hinge.

16. A hair styling apparatus comprising:

first and second arms each having opposite ends and an axis extending between the opposite ends, the first and second arms pivotably secured to one another for selective, pivotal movement toward one another to configure the hair styling apparatus in a closed position;

first and second heating members on the respective first and second arms for applying heat to hair between the first and second arms in the closed position of the hair styling apparatus, the first and second heating members having respective hair-heating surfaces in generally opposing relationship with one another, each hair-heating surface having a lateral edge;

a first curling component operatively connected to the first arm and having a curling edge, the curling edge of the first curling component being selectively movable laterally with respect to the hair-heating surface of the first heating member to configure the first curling component between a first retracted configuration, in which the curling edge of the first curling component is spaced a first retracted lateral distance from the lateral edge of the hair-heating surface of the first heating member, and a first extended configuration, in which the curling edge of the first curling component is spaced a first extended lateral distance, greater than the first retracted lateral distance, from the lateral edge of the hair-heating surface of the first heating member; and a second curling component operatively connected to the second arm and having a curling edge, the curling edge of the second curling component being selectively movable laterally with respect to the hair-heating surface of the second heating member to configure the second curling component between a second retracted configuration, in which the curling edge of the second curling component is spaced a second retracted lateral distance from the lateral edge of the hair-heating surface of the second heating member, and a second extended configuration, in which the curling edge of the second curling component is spaced a second extended lateral distance, greater than the second retracted lateral distance, from the lateral edge of the hair-heating surface of the second heating member.

17. The hair styling apparatus set forth in claim 16 wherein each of the first and second curling components comprises a respective locking mechanism for selectively and releasably locking the corresponding curling component in the respective retracted and extended configurations.

18. The hair styling apparatus set forth in claim 17 wherein the curling edge of each of the first and second curling components is selectively movable laterally with respect to the hair-heating surface of the corresponding heating member to further configure the corresponding curling component in an intermediate configuration, in which the corresponding curling edge is spaced an intermediate lateral distance, intermediate the respective retracted and extended lateral distances, from the lateral edge of the corresponding hair-heating surface.

19. The hair styling apparatus set forth in claim 18 wherein the curling edge of each of the first and second curling components is selectively and independently movable laterally with respect to the hair-heating surface of the corresponding heating member to a plurality of discrete displacement intervals to selectively configure the corresponding curling component in the respective retracted, extended, and intermediate configurations.

20. The hair styling apparatus set forth in claim 16 wherein each of the first and second curling components comprises a body slidably connected to the corresponding one of the first and second arms, the body having a curling surface, wherein each of the curling edges is at least partially defined by the curling surface of the corresponding body.

21. The hair styling apparatus set forth in claim 20 wherein each of the first and second arms has an exterior surface and a recess, wherein at least a portion of the body of each of the first and second curling components is received in the recess of the corresponding arm when the corresponding curling component is in the respective retracted configuration and is removed from the corresponding recess when the corresponding curling component is in the respective extended configuration.

22. The hair styling apparatus set forth in claim 21 wherein the body of each of the first and second curling components is commensurate in size and shape with the recess of the corresponding arm.

23. A method of styling hair using a hair styling apparatus of the type including first and second arms that are pivotably secured to one another for selective, pivotal movement toward one another to close the hair styling apparatus, and first and second heating members on the respective first and second arms having respective hair-heating surfaces with respective lateral edges, the method comprising:

telescopingly sliding a curling component of the hair styling apparatus laterally to adjust a lateral distance between a curling edge of the curling component and the lateral edge of the first heating member to configure the curling component in a selected one of a plurality of different configurations;

disposing hair between the hair-heating surfaces of the first and second heating members; and curling the hair using the curling edge of the curling component.

24. The method set forth in claim 23 wherein said adjusting a lateral distance comprises displacing the curling edge laterally outward from the lateral edge of the first heating member.

25. The method set forth in claim 24 further comprising locking the curling component in said selected one of a plurality of different configurations after said adjusting a lateral distance.

* * * * *